US005604508A

United States Patent [19]

Atkinson

[11] Patent Number: 5,604,508

[45] Date of Patent: Feb. 18, 1997

[54] ANTENNA ASSEMBLY AND INTERFACE BRACKET FOR SATELLITE AND TERRESTRIAL ANTENNAS

[75] Inventor: James L. Atkinson, Richland Center, Wis.

[73] Assignee: Kaul-Tronics, Inc., Richland Center, Wis.

[21] Appl. No.: 583,618

[22] Filed: Jan. 5, 1996

[51] Int. Cl.[6] ..... H01Q 21/00

[52] U.S. Cl. ..... 343/879; 343/725; 343/890; 343/892; 343/893; 403/389

[58] Field of Search ..... 343/893, 892, 343/879, 878, 891, 890, DIG. 2, 725, 882, 840; 248/201, 225.31; 403/388, 389; H01Q 21/00, 1/12

[56] References Cited

U.S. PATENT DOCUMENTS

| | | | |
|---|---|---|---|
| 2,269,947 | 1/1942 | Ludwig | 343/892 |
| 2,371,539 | 3/1945 | Morch | 343/879 |
| 2,640,934 | 6/1953 | Lago | 343/892 |
| 3,550,146 | 12/1970 | Ererle | 343/879 |
| 4,771,973 | 9/1988 | Kohlman et al. | 403/388 |
| 4,860,021 | 8/1989 | Kurosawa et al . | 343/840 |
| 4,931,809 | 6/1990 | Putman et al. | 343/892 X |
| 5,111,212 | 5/1992 | Desatnick et al. | 343/892 X |

FOREIGN PATENT DOCUMENTS

| | | | |
|---|---|---|---|
| 0149206 | 8/1985 | Japan | 343/840 |

OTHER PUBLICATIONS

"Tennamount™", Advertisement, no date.

*Primary Examiner*—Donald T. Hajec
*Assistant Examiner*—Tho Phan
*Attorney, Agent, or Firm*—Foley & Lardner

[57] ABSTRACT

In accordance with the present invention an antenna assembly is provided whereby a satellite dish antenna and a terrestrial antenna, for receiving satellite transmissions and local broadcast television signals, respectively, are mounted in the same location. A single base mounting bracket is used to mount the antenna assembly on a wall or other structure. The satellite antenna is secure to the base mounting bracket by a satellite antenna mast. An antenna interface bracket is also secured to the base mounting bracket. A terrestrial antenna mast, upon which a terrestrial antenna is mounted, is secured to the antenna interface bracket. The antenna interface bracket includes a central portion in the shape of an elongated parallelogram. At each end of the central portion of the antenna interface bracket are mounting ends which are attached at angles with respect to opposite faces of the central portion of the antenna interface bracket. Mounting holes are preferably included in the mounting ends of the interface bracket so that the interface bracket may be mounted with fasteners at one end to the base mounting bracket, and at the other end to the mast of the terrestrial antenna. The antenna interface bracket of the present invention is particularly suited for use with 18 inch diameter digital satellite dish antennas and omni-directional terrestrial antennas having similar dimensions.

20 Claims, 3 Drawing Sheets

ANTENNA ASSEMBLY AND INTERFACE BRACKET FOR SATELLITE AND TERRESTRIAL ANTENNAS

FIELD OF THE INVENTION

This invention pertains generally to the field of antennas for receiving television signals, and more particularly to structures for supporting satellite and terrestrial antennas.

BACKGROUND OF THE INVENTION

In recent years there has been a proliferation in the number of satellite antennas in use by individual households. The use of satellite antennas to receive satellite television transmissions has provided these households with access to hundreds of television channels. This often represents many more television channels than are available through local cable television systems. The use of satellite antennas also makes these television transmissions accessible to rural households which may not have access to cable television. In most cases, however, local television station broadcasts are not made available over the satellite transmission. Thus, for households desiring to watch local over-the-air broadcast channels, as well as channels available through the satellite transmission, a second, terrestrial, antenna is required in order to receive the local channels.

The requirement for two separate antennas, satellite and terrestrial, presents several difficulties. First, the requirement for two separate antenna support structures increases the costs incurred in setting up and maintaining the antennas to receive both local and satellite television channels. Also, mounting two separate antennas in separate locations requires separate cables to be run from each antenna location to the location of the television receiver. This also increases setup and maintenance costs. Finally, the mounting of two separate antennas in two separate locations is not aesthetically pleasing.

A solution to these problems is to mount the satellite and terrestrial antennas in the same location. This allows the satellite and terrestrial antennas to share the same support structures, as well as much of the wiring necessary to connect the antennas to the television receiver. An example of a known device used to mount a terrestrial antenna in the same location as a satellite antenna is the Tennamount™, which is designed to attach a conventional terrestrial di-pole antenna to the support structure of a large (72–120 inch diameter) satellite dish antenna. This device consists essentially of a bent tubular structure which is connected at one end to a satellite antenna's support post and at the other end to a mast supporting a conventional terrestrial di-pole antenna. The bend in the device provides necessary physical separation between the satellite dish and the terrestrial antenna and mast.

Most recently, satellite television systems have become available which receive digital television signals from a satellite. These new systems provide higher quality video and sound, and feature small (e.g., 18 inch diameter) satellite dish antennas, which may be conveniently mounted on the wall or roof of a house. This represents a significant improvement over the earlier, large diameter, satellite dishes which typically had to be mounted separate from the house, such as on a heavy support post mounted in a concrete footing in the ground. However, the new digital satellite television systems still typically do not provide access to local broadcast television channels. Thus, it is still desirable to use a terrestrial antenna in addition to the digital satellite antenna.

SUMMARY OF THE INVENTION

In accordance with the present invention, an antenna assembly is provided which includes both a satellite antenna and a terrestrial antenna. The satellite antenna may preferably be of the small (18 inch diameter) dish-type typically used to receive digital television transmissions from a satellite. The terrestrial antenna is designed to receive UHF/VHF broadcast signals from local television stations. Preferably, the terrestrial antenna may be of the omni-directional type which is designed to receive UHF/VHF and FM broadcast from any direction without the use of a rotor. The terrestrial antenna is also preferably of approximately the same size as the satellite antenna. The antenna assembly of the present invention may conveniently be mounted via a single base mounting bracket to a wall, roof, or other structure of a house. Since the two antennas are mounted in the same location, they may share much of the same wiring to carry signals from the antennas to the television receiver. Moreover, the installation of both types of antennas in the same location is aesthetically more pleasing than two separate installations.

To form the combined satellite/terrestrial antenna assembly of the present invention, a new antenna interface bracket is provided. The interface bracket includes an essentially flat central portion in the shape of an elongated parallelogram. Attached at each of the shorter ends of the central portion is a mounting end structure. The mounting end structure at the first end of the central portion is attached at an angle thereto. The second mounting end structure, at the opposite end of the central portion, is also attached at an angle with respect to the central portion, but is angled in a direction opposite to that of the first mounting end structure. The first mounting end structure includes mounting holes, or some other structure, whereby the interface bracket may be mounted to the antenna assembly base mounting bracket, which, in turn, may be secured to the wall, roof, or other house structure. The second mounting end structure includes mounting holes, or some other structure, whereby the mast of a terrestrial television antenna may be secured to the interface bracket.

The antenna interface bracket of the present invention may preferably be made as a steel stamping. An essentially flat sheet of steel is first drilled or pierced at each end to provide mounting holes for the mounting end structures of the interface bracket. After the mounting holes are formed, the steel sheet is stamped so that the mounting end structures of the interface brackets are broken or bent into shape at opposite angles with respect to the central portion of the interface bracket. The central portion of the interface bracket may also be embossed, thereby forming a raised surface on the central portion of the interface bracket, in order to strengthen the interface bracket.

The antenna assembly of the present invention is formed, and the antenna interface bracket is used, by first mounting the base mounting bracket in position on the wall or other structure upon which the antenna assembly is to be supported. The base mounting bracket directly supports a satellite antenna mast which, in turn, supports the satellite antenna. The interface bracket of the present invention is secured at the first mounting end support to the base mounting bracket. The mast of a terrestrial antenna is then secured to the second mounting end structure of the interface bracket. The length of the central portion of the interface bracket, the angle of the parallelogram sides of the central portion, and the angle of the first and second mounting ends with respect to the central portion, are selected so that, when assembled, the terrestrial antenna and mast are spaced away from the dish of the satellite antenna. The mounting ends of the interface bracket are preferably angled with respect to the central portion of the interface bracket at an angle which allows for mounting the terrestrial antenna mast parallel with a vertical portion of the satellite antenna mast. Cables carrying separate terrestrial and satellite signals from the terrestrial and satellite antennas may be joined by a connector into a single cable which connects the antenna assembly to a remote television receiver.

Further objects, features, and advantages of the present invention will be apparent from the following detailed description taken in conjunction with the accompanying drawings.

DETAILED DESCRIPTION OF THE INVENTION

Figure 1:
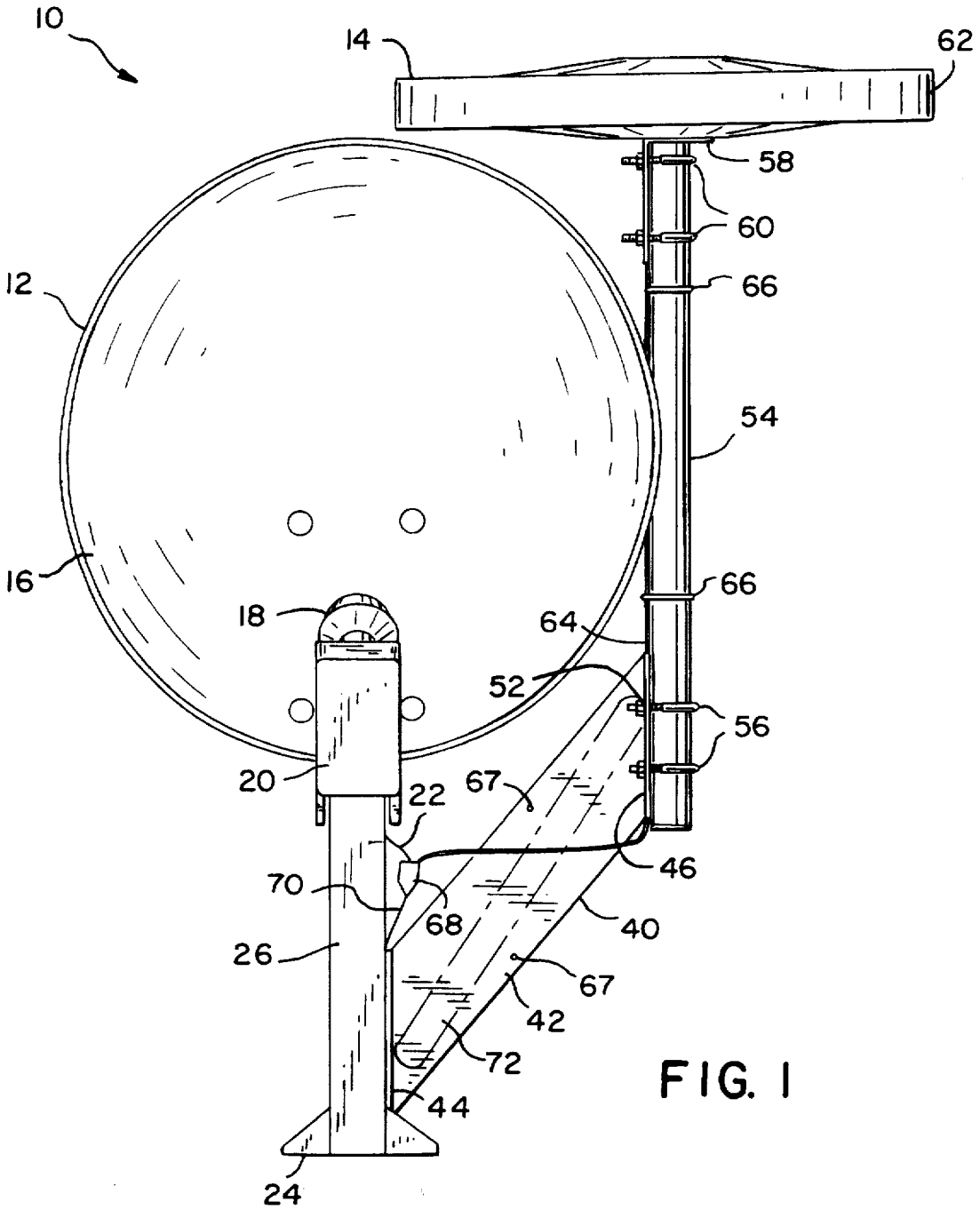
FIG. 1 is a front view of an antenna assembly in accordance with the present invention.
Figure 2:
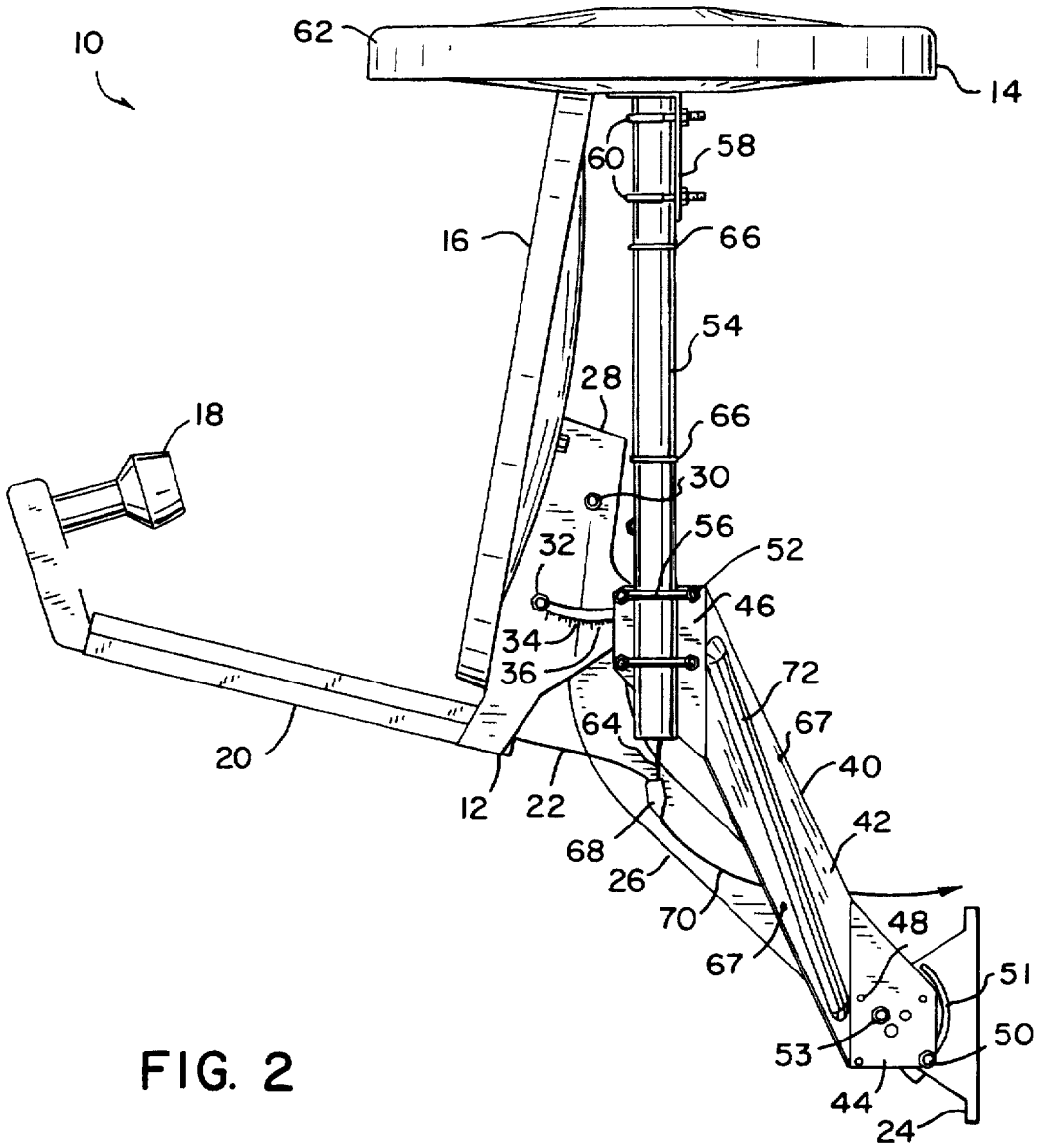
FIG. 2 is a side view of the antenna assembly of FIG. 1.

An antenna assembly in accordance with the present invention is shown generally at 10 in FIGS. 1 and 2. The antenna assembly includes a satellite antenna 12 and a terrestrial antenna 14. The satellite antenna 12 includes a satellite dish 16 which receives a signal from a satellite and reflects the signal onto a signal pickup 18 which is positioned in front of the dish 16 by an arm 20. A satellite antenna cable 22 carries the received satellite signal from the pickup 18 away from the antenna 12. An example of a preferable satellite antenna 12 for the antenna assembly 10 of the present invention is the 18 inch diameter satellite dish antenna which is part of the DSS Satellite System made by RCA.

The antenna assembly 10 includes a base mounting bracket 24, which may typically be provided with the satellite antenna 12. The base mounting bracket 24 may be secured, for example, to a wall, roof, or other structure of a house. To the base mounting bracket 24 a satellite antenna mast 26 is secured. The satellite antenna mast 26 extends horizontally and vertically away from the structure to which the base mounting bracket 24 is attached. At the opposite end of the satellite antenna mast 26 from the base mounting bracket 24, the satellite dish 16 and arm 20 are attached to the satellite antenna mast 26 by a bracket 28. The bracket 28 may preferably be rotated about a pivot point 30 to adjust the elevation of the satellite dish 16. A nut 32 is attached to the end of a bolt, or other fastener, which extends through a slot 34 in the bracket 28. When the bolt 32 is loosened, the bracket 28 is allowed to rotate about the pivot point 30. Thereby, the satellite dish 16 may be adjusted to a desired elevation. Degree markings 36 adjacent to the slot 34 allow the satellite dish 16 to be set easily and accurately at the desired elevation. When the bolt 32 is tightened, the satellite dish 16 is fixed at the selected elevation.

An antenna interface bracket 40 in accordance with the present invention is used to mount the terrestrial antenna 14 to the antenna assembly 10. The antenna interface bracket 40 includes a central portion 42 and first and second mounting ends 44 and 46. The first mounting end 44 includes mounting holes 48 whereby the antenna interface bracket 40 may be mounted to the base mounting bracket 24 using a fastener 50, such as a quarter inch bolt and nut. The fastener 50 may be mounted in a slot 51 in the base mounting bracket 24. Thus, when the fastener 50 is loosened, the antenna interface bracket may be rotated about a second fastener 53 with the first fastener 50 sliding in the slot 51. In this way the position of the bracket may be adjusted so that the terrestrial antenna mast 54 is vertical. Tightening the fastener 50 secures the interface bracket 40 in the desired position. The second mounting end 46 includes a second set of mounting holes 52 whereby the mast 54 for the terrestrial antenna 14 may be attached to the antenna interface bracket 40 using fasteners 56, such as 2¼ inch U-bolts.

The mast 54 of the terrestrial antenna 14 is preferably a light weight, high strength, metal tube. The terrestrial antenna 14 may be mounted to the mast 54 in any conventional manner, such as by a bracket 58 attached to the terrestrial antenna 14 and fasteners 60, such as U-bolts, to secure the bracket 58 to the mast 54. The terrestrial antenna 14 may be of any conventional terrestrial antenna design. A preferred terrestrial antenna is the UHF/VHF omni-directional antenna manufactured by Kaul-Tronics, Inc., of Richland Center, Wis. This antenna, marketed under the name Omni-Vision 20/20, includes a polymer based plastic, UV protected, weather proof housing 62 in which the antenna elements reside. The housing is 16.75 inches in diameter. This antenna is designed to receive UHF/VHF and FM from any direction without the use of a rotor.

A terrestrial antenna cable 64 carries a received terrestrial television signal away from the terrestrial antenna 14. The terrestrial antenna cable 64 may be run down the interior of the terrestrial antenna mast 54, or secured thereto in a conventional manner, such as by using plastic straps 66. Clip holes 67 may be provided in the central portion 42 of the interface bracket 40 whereby automative-type cable clips (not shown) may be mounted to hold the cable 64 against the interface bracket 40. The cable 22 carrying the signal from the satellite antenna 16 is preferably joined with the cable 64 from the terrestrial antenna 14 by a connector 68. At the connector 68 the separate antenna cables 22 and 64 are joined into a single cable 70 which is then run to a remote location, where it is connected to satellite and terrestrial television receivers (not shown). It is apparent that the mounting of the satellite antenna 16 and terrestrial antenna 14 together in one location in accordance with the antenna assembly of the present invention makes possible the use of the single cable 70 to carry signals from both the satellite antenna 16 and terrestrial antenna 14 away from the antenna assembly 10 to a receiver unit located remotely from the antenna assembly 10. Since the antenna assembly 10 may be located some distance away from the receiver unit, use of the antenna assembly of the present invention saves the expense involved in running and maintaining separate satellite and terrestrial cables over long distances.

Figure 3:
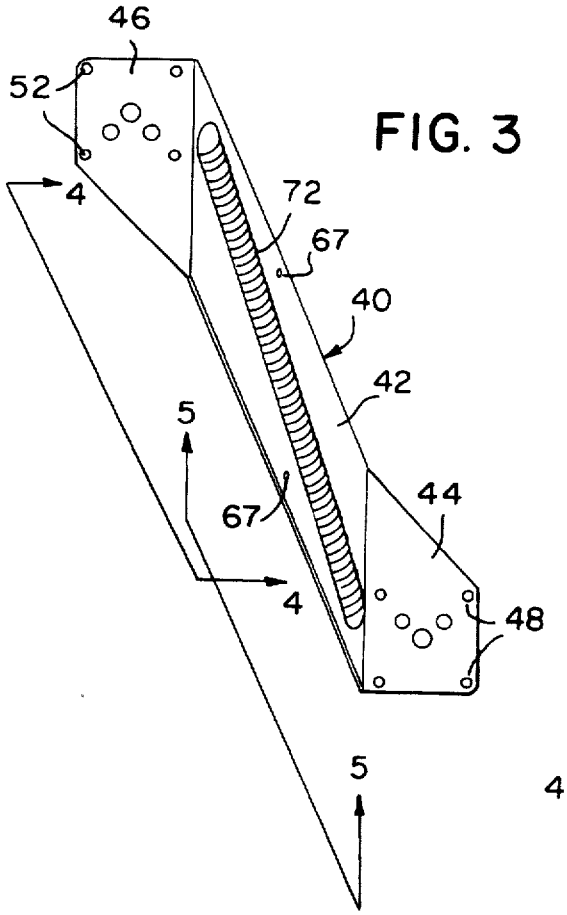
FIG. 3 is a perspective view of an antenna interface bracket in accordance with the present invention.
Figure 4:
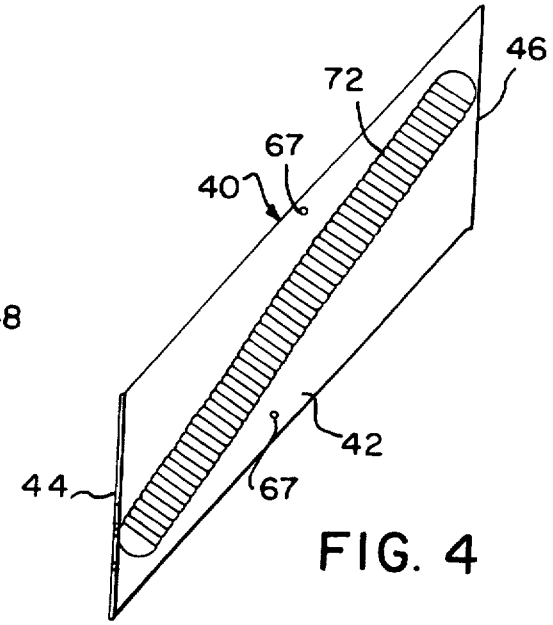
FIG. 4 is a plan view of the antenna interface bracket of FIG. 3 taken along the line 4—4.
Figure 5:
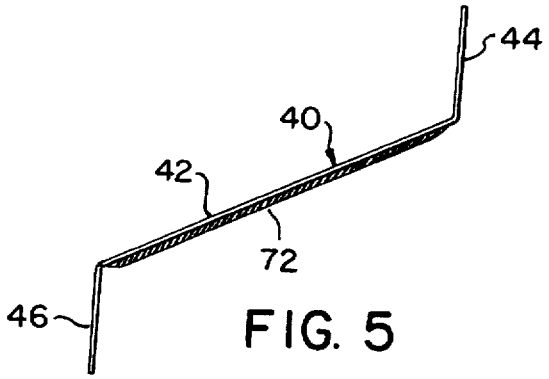
FIG. 5 is a side view of the antenna interface bracket of FIG. 3 taken along the line 5—5.

The antenna interface bracket 40 of the present invention is shown in more detail in FIGS. 3–5. As shown, the antenna interface bracket 40 includes an essentially flat central portion 42 in the shape of an elongated parallelogram. The acute angles of the parallelogram may preferably be approximately 39.5 to 45 degrees, however, any angles may be used, and the parallelogram may even have right angle corners. The central portion 40 preferably includes a raised embossed section 72. The embossed section 72 provides additional strength to the central portion 42 of the antenna interface bracket 40, thereby providing more stability for the bracket 40, especially in the face of high winds. The embossed portion 72 preferably runs diagonally from one end of the central portion 42 to the other end of central portion 42. Other techniques for strengthening the central portion 42 of the antenna interface bracket 40 may also be used, such as increasing the thickness of the central portion 40, or welding or otherwise securing metal strips along the length of the central portion 42.

The first and second mounting ends 44 and 46 are attached to the short sides of the central portion parallelogram and are attached at angles with respect to the faces of the central portion 42. The mounting ends 44 and 46 are attached in opposite directions with respect to the faces of the central portion 42. The first mounting bracket 44 is thus attached at an angle inclined toward one face of the central portion 42 with the second mounting bracket 46 attached at an angle inclined toward the other face of the central portion 42. The incline angle, however, is preferably the same for each mounting end 44 and 46. Thus, the first and second mounting ends 44 and 46 are preferably at 180 degrees with respect to each other. The first and second mounting ends 44 and 46 may preferably be attached at approximately 62 degrees with respect to the opposite faces of the central portion 42.

Variations on the size of the corner angles forming the parallelogram of the central portion 42, and of the angles between the mounting ends 44 and 46 and the central portion 42, may be made. However, it is desirable that these angles be chosen such that, when the interface bracket 40 is assembled as part of the antenna assembly 10, the terrestrial antenna mast 54 is mounted in a vertical position, in parallel with the vertical part of the satellite antenna mast 26. These angles, as well as the length of the central portion 42 of the antenna interface bracket 40, must also be selected so that the antenna interface bracket 40 separates the satellite antenna 12 from the terrestrial antenna 14 so that the antennas are not in contact.

The parallelogram forming the central portion 42 may, for example, be approximately 13 inches long along its longest dimension, and approximately five inches long along its shorter dimension. These dimensions are appropriate for an antenna interface bracket 40 used in an antenna assembly 10 wherein the satellite antenna 16 includes an 18 inch satellite dish, and the terrestrial antenna 14 is of a similar dimension, such as an omni-directional antenna which is less than 18 inches in diameter. Of course, by changing the dimensions of the antenna interface bracket 40, the present invention may be employed with satellite and terrestrial antennas of any size.

Each of the mounting ends 44 and 46 preferably includes a pattern of mounting holes 48 and 52, respectively, whereby, as described earlier, the antenna interface bracket 40 is secured using fasteners to the base mounting bracket 24 and to the terrestrial antenna mast 54, respectively. A pattern of several mounting holes 48 and 52 is preferred so that a single antenna interface bracket 40 may be used in combination with a variety of base mounting brackets 24 and structures for mounting the interface bracket 40 to the base mounting bracket 24 and terrestrial antenna mast 54.

The antenna interface bracket 40 may preferably be made as a steel stamping of, for example, 12 gauge steel. The interface bracket 40 may thus be formed from an essentially flat, elongated piece of steel, which, as described above, preferably includes an embossed section 72 to provide strength to the interface bracket 40. The mounting holes 48 and 52 are pierced or drilled through the ends of the piece of steel. The flat piece is then stamped in order to bend the, now pierced, ends of the steel piece with respect to opposite faces of the central portion 42 of the interface bracket 40, in order to form the mounting ends 44 and 46 of the interface bracket 40. The flat steel piece may also be first stamped and then pierced to form the interface bracket 40.

The interface bracket 40 may also be made from a variety of other materials which have sufficient strength and rigidity. Also, the mounting ends 44 and 46 may be formed with respect to the central portion 42 by methods other than stamping. For example, the ends 44 and 46 may be attached to the central portion 42 by welding separate steel mounting ends 44 and 46 onto a separate steel piece forming the central portion 42.

This invention is not confined to the particular embodiments herein illustrated and described, but embraces such modified forms thereof has come within the scope of the following claims.

What is claimed is:

1. An antenna assembly, comprising (a) a base mounting bracket adapted to be secured to a wall;

(b) a satellite dish antenna secured to a satellite dish antenna mast which is secured to the base mounting bracket;

(c) an antenna interface bracket having a central portion with a front face and a back face and wherein each face is in the shape of an elongated parallelogram with two short sides and two long sides, a first mounting end which is secured to the base mounting bracket and to a one of the short sides at an angle inclined toward the front face and away from the back face, and a second mounting end which is secured to the other of the short sides at an angle inclined toward the back face and away from the front face; and (d) a terrestrial antenna secured to a terrestrial antenna mast which is secured to the second mounting end of the antenna interface bracket.

2. The antenna assembly of claim 1 wherein the satellite dish antenna includes a satellite dish which is approximately 18 inches in diameter.

3. The antenna assembly of claim 2 wherein the terrestrial antenna is no more than 18 inches across in its longest dimension.

4. The antenna assembly of claim 3 wherein the terrestrial antenna is an omni-directional antenna including a weather proof housing which is less than 18 inches in diameter.

5. The antenna assembly of claim 1 wherein the central portion of the antenna interface bracket includes an embossed portion to strengthen the interface bracket.

6. The antenna assembly of claim 5 wherein the embossed portion extends diagonally across the central portion of the antenna interface bracket.

7. The antenna assembly of claim 1 wherein the elongated parallelogram shape of the faces of the central portion of the antenna interface bracket includes corners which are not right angles.

8. The antenna assembly of claim 1 wherein the first mounting end is secured at an angle of approximately 62 degrees from the front face of the central portion of the antenna interface bracket, and wherein the second mounting end is secured at an angle of approximately 62 degrees from the back face of the central portion of the antenna interface bracket.

9. The antenna assembly of claim 1 wherein the antenna interface bracket is made of steel.

10. The antenna assembly of claim 9 wherein the antenna interface bracket is formed of a flat sheet of steel which is stamped to establish the angle of the mounting ends with respect to the faces of the central portion.

11. The antenna assembly of claim 1 wherein the terrestrial antenna mast is secured to the second mounting end of the antenna interface bracket using a U-bolt.

12. The antenna assembly of claim 1 including additionally a satellite antenna cable to carry a satellite signal from the satellite dish antenna, a terrestrial antenna cable to cary a terrestrial signal from the terrestrial antenna, a cable connector to join the satellite antenna cable and the terrestrial antenna cable, and an antenna assembly cable to carry the combined satellite and terrestrial signals from the cable connector.

13. An antenna interface bracket for mounting a satellite dish antenna and a terrestrial antenna in a single antenna assembly, comprising:

(a) a central portion with a front face and a back face and wherein each face is in the shape of an elongated parallelogram with two short sides and two long sides;

(b) a first mounting end which is adapted to be secured to a base mounting bracket which secures a satellite dish antenna to a wall and secured to a one of the short sides of the central portion at an angle inclined toward the front face of the central portion and away from the back face of the central portion; and (c) a second mounting end which is secured to the other of the short sides of the central portion at an angle inclined toward the back face and away from the front face and which is adapted to have a terrestrial antenna secured thereto.

14. The antenna interface bracket of claim 13 wherein the central portion of the antenna interface bracket includes an embossed portion to strengthen the interface bracket.

15. The antenna interface bracket of claim 14 wherein the embossed portion extends diagonally across the central portion of the antenna interface bracket.

16. The antenna interface bracket of claim 13 wherein the elongated parallelogram shape of the faces of the central portion of the antenna interface bracket includes corners which are not right angles.

17. The antenna interface bracket of claim 13 wherein the first mounting end is secured at an angle of approximately 62 degrees from the front face of the central portion of the antenna interface bracket, and wherein the second mounting end is secured at an angle of approximately 62 degrees from the back face of the central portion of the antenna interface bracket.

18. The antenna interface bracket of claim 13 wherein the antenna interface bracket is made of steel.

19. The antenna interface bracket of claim 18 wherein the antenna interface bracket is formed of a flat sheet of steel which is stamped to establish the angle of the mounting ends with respect to the faces of the central portion.

20. The antenna interface bracket of claim 13 wherein the first and second mounting ends including mounting holes through the antenna interface bracket.

* * * * *